US005330674A

United States Patent [19]

Urfer et al.

[11] Patent Number: 5,330,674

[45] Date of Patent: Jul. 19, 1994

[54] METHOD FOR INCREASING THE EFFICIENCY OF A DISINFECTANT CLEANING COMPOSITION USING ALKYL POLYGLYCOSIDES

[75] Inventors: Allen D. Urfer, Lansdale; Virginia L. Lazarowitz, Hatfield, both of Pa.

[73] Assignee: Henkel Corporation, Plymouth Meeting, Pa.

[21] Appl. No.: 942,555

[22] Filed: Sep. 9, 1992

[51] Int. Cl.[5] ..... C11D 3/22; C11D 1/62; C11D 3/48; C11D 11/00

[52] U.S. Cl. ..... 252/176.17; 252/106; 252/547

[58] Field of Search ..... 252/174.17, 547, 106; 422/37

[56] References Cited

U.S. PATENT DOCUMENTS

| | | | |
|---|---|---|---|
| H269 | 5/1987 | Malik | 422/37 |
| H303 | 7/1987 | Malik et al. | 514/85 |
| H468 | 5/1988 | Malik et al. | 252/542 |
| 3,547,828 | 12/1970 | Mansfield et al. | 252/351 |
| 4,493,773 | 1/1985 | Cook et al. | 252/8.8 |
| 4,606,850 | 8/1986 | Malik | 252/528 |
| 4,627,931 | 12/1986 | Malik | 252/153 |
| 4,748,158 | 5/1988 | Biermann et al. | 514/25 |
| 4,755,327 | 7/1988 | Bernarducci et al. | 252/547 |
| 4,775,424 | 10/1988 | Wisotzki et al. | 134/42 |
| 4,804,497 | 2/1989 | Urfer et al. | 252/8.8 |
| 4,834,903 | 5/1989 | Roth et al. | 252/174.17 |
| 4,920,100 | 4/1990 | Lehmann et al. | 514/23 |

FOREIGN PATENT DOCUMENTS 0094118 11/1983 European Pat. Off. .

*Primary Examiner*—Paul Lieberman
*Assistant Examiner*—A. Hertzog
*Attorney, Agent, or Firm*—Wayne C. Jaeschke; John E. Drach; Henry E. Millson, Jr.

[57] ABSTRACT

The germicidal efficiency of an aqueous disinfectant cleaning composition is increased by incorporating an effective amount of a compound of the formula I $$R—O(—G)_n \qquad \text{I}$$

wherein R is an alkyl group having from about 8 to about 22 carbon atoms, G is a saccharide residue having 5 or 6 carbon atoms; and n is a number from 1 to 10 into an aqueous composition which contains a compound of the formula II $$R_2R_3R_4R_5NX$$

wherein $R_2$ is a benzyl or $C_{1-4}$ alkyl substituted benzyl group, and each of $R_3$, $R_4$, and $R_5$ is independently an alkyl group having from about 8 to about 22 carbon atoms.

2 Claims, No Drawings

METHOD FOR INCREASING THE EFFICIENCY OF A DISINFECTANT CLEANING COMPOSITION USING ALKYL POLYGLYCOSIDES

BACKGROUND OF THE INVENTION

1. Field of the Invention

This invention relates to a method for increasing the efficiency of a germicidal cleaning composition.

2. Description of the Related Art

Investigations into the microbiological activities of alkyl glycosides have shown that they exhibit no significant antimicrobial activity even at concentrations as high as 10,000 ppm. Furthermore, combinations of alkyl glycosides with quaternary ammonium compounds are similarly undistinguished in their antimicrobial effect. While quaternary ammonium compounds exhibit bactericidal activity, their use with an alkyl glycoside surfactant, as described, for example, in U.S. Pat. No. 3,547,828, produces no increased or unexpected bactericidal effect. U.S. Pat. No. 4,748,158 teaches the use of alkyl glycosides as potentiating agents for increasing the microbicidal activity of bactericidally active biguanide compounds, especially microbicidal activity against gram-positive bacteria, in antiseptic preparations. U.S. Pat. No. 4,834,903 teaches composition in which the above-described oxyalkylated long chain glycoside composition is utilized in combination with one or more anionic, cationic or nonionic cosurfactant ingredients and/or with one or more detergent builder components.

SUMMARY OF THE INVENTION

It has been found that the germicidal efficiency of an aqueous disinfectant cleaning composition can be increased by incorporating an effective amount of a compound of the formula I $$R—O(—G)_n \qquad I$$

wherein R is an alkyl group having from about 8 to about 22 carbon atoms, G is a saccharide residue having 5 or 6 carbon atoms; and n is a number from 1 to 10 into an aqueous composition which contains a compound of the formula II $$R_2R_3R_4R_5NX$$

wherein $R_2$ is an alkyl group having from about 1 to about 22 carbon atoms, a benzyl or $C_{1-4}$ alkyl substituted benzyl group, and each of $R_3$, $R_4$, and $R_5$ is independently an alkyl group having from about 1 to about 22 carbon atoms and X is a halide.

DESCRIPTION OF THE PREFERRED EMBODIMENTS

Other than in the operating examples, or where otherwise indicated, all numbers expressing quantities of ingredients or reaction conditions used herein are to be understood as modified in all instances by the term "about".

Compounds of the formula I are commercial surfactants and are available, for example, from Henkel Corporation, Ambler, PA., 19002 under the trademark names APG ®, Plantaren TM, or Glucopon TM. Examples of such surfactants include but are not limited to:

1. Glucopon TM 225—an alkylpolyglycoside in which the alkyl group contains 8 to 10 carbon atoms.

2. APG TM 325—an alkyl polyglycoside in which the alkyl group contains 9 to 11 carbon atoms.
3. Glucopon TM 625—an alkyl polyglycoside in which the alkyl groups contains 12 to 16 carbon atoms.
4. APG TM 300—an alkyl polyglycoside substantially the same as the 325 product above but having a different average degree of polymerization.
5. Glucopon TM 600—an alkylpolyglycoside substantially the same as the 625 product above but having a different average degree of polymerization.
6. Plantaren TM 2000—a $C_{8-16}$ alkyl polyglycoside.
7. Plantaren TM 1300—a $C_{12-16}$ alkyl polyglycoside.
8. Plantaren TM 1200—a $C_{12-16}$ alkyl polyglycoside.
9. Glucopon TM 425—an alkylpolyglycoside in which the alkyl group contains 8 to 16 carbon atoms.

Other examples include alkyl polyglycoside surfactant compositions which are comprised of mixtures of compounds of formula II wherein Z represents a moiety derived from a reducing saccharide containing 5 or 6 carbon atoms; a is zero; b is a number from 1.8 to 3; and $R^4$ is an alkyl radical having from 8 to 20 carbon atoms. The composition is characterized in that it has increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in copending application Ser. No. 7/810,588, filed on Dec. 19, 1991, the entire contents of which are incorporated herein by reference. The skilled artisan may find it beneficial to use a mixture of compounds of the formula I in order to obtain a maximum increase in the efficiency of a disinfectant cleaning composition. The preferred compounds of formula I are Glucopon TM 425 surfactant and Glucopon TM 625 surfactant. An effective amount of a compound of formula I is any amount which will increase the efficiency of a compound of formula II. The effective amount will typically be in the range of the ratio of a compound of formula I to formula II from 10:1 to 1:10.

The compounds of formula II which can be used in the process according to the invention are quaternary ammonium compounds of the formula $R_2R_3R_4R_5NX$ wherein $R_2$ is an alkyl group having from about 1 to about 22 carbon atoms, a benzyl or $C_{1-4}$ alkyl substituted benzyl group; and each of $R_3$, $R_4$, and $R_5$ is independently an alkyl group having from about 1 to about 22 carbon atoms and X is a halide ion such as chloride, bromide, or iodide ion. Examples of suitable quaternary ammonium compounds include but are not limited to dodecyltrimethylammonium chloride, tetradecyltrimethylammonium chloride, tallow trimethylammonium chloride, soya trimethylammonium chloride, coco trimethylammonium chloride, dioctyldimethylammonium chloride, didodecyldimethylammonium chloride, dicoco trimethylammonium chloride, tridodecyldimethylammonium chloride, and the like. More than one quaternary ammonium compound can be used in the disinfectant cleaning composition whose efficiency is to be increased by incorporation of compound of the formula I. The preferred compounds of formula II are Barquat® 4250Z and Barquat® 4280Z, which are mixtures of $C_{12-18}$ alkyl dimethylbenzylammonium chlorides and are available from Lonza, Inc., Fair Lawn, NJ 07410. The amount of a compound of formula II typically in a disinfectant cleaning composition whose efficiency is to be increased by incorporation of compound of the formula I will typically be from the ratio of a compound of formula I to formula II from 10:1 to 1:10. The disinfectant cleaning composition whose efficiency is to be increased by incorporation of compound of the formula I can also contain other compounds normally used in such compositions such as builders, brighteners, etc. One preferred embodiment of the present invention is a process wherein in the compound of formula I R is a $C_{8-16}$ alkyl group, G is a glucose residue, and n is 1.6. Another preferred embodiment of the present invention is a process wherein in the compound of formula I R is a $C_{12-16}$ alkyl group, G is a glucose residue, and n is 1.6. The following examples are meant to illustrate but not limit the invention.

EXAMPLE 1

Disinfectant cleaning compositions A, B, and C having the following compositions were prepared by mixing the ingredients together. The compositions were then tested for their ability to inhibit the growth of the test organisms Staphylococcus aureus and Escherichia coli. A cleaning composition, containing no quaternary ammonium compound, was diluted 1/128 with distilled water. Eight 9 ml aliquots were then dispensed, along with one aliquot of distilled water. A 2% (vol/vol) solution of Barquat® 4250Z was prepared using the diluted cleaning composition as the diluent. Serial two-fold dilutions were made, through 15.6 ppm, again using the diluted cleaning composition as the diluent. These stock dilutions were the used to transfer 1 ml to the 9 ml aliquots, yielding a series of samples one-tenth as concentrated as the original two-fold dilutions. The final concentrations were 2000, 1000, 500, 250, 125, 62.5, 31.25, and 15.6 ppm of Barquat® 4250Z. To each final dilution was added 0.1 ml of *S. aureus* and *E. coli* stock cultures which had been incubated overnight at 35° C. After gentle agitation, each mixture was left undisturbed for 10 minutes. A loopful of each mixture was aseptically heavily inoculated on to the surface of a Letheen Agar plate. The plates were then incubated at 35° C., afterwhich the plates were graded for growth on a scale of 0 (no growth) to 4 (heavy growth). The results, which appear in Table 2, show that Samples B and C are more effective in inhibiting the growth of both *S. aureus* and *E. coli* than Sample A whereas Sample is C is more effective in inhibiting the growth of *S. aureus* than is Sample A or B. All test samples contain a nonionic surfactant but only samples B and C contain a surfactant of formula I. The composition of samples A, B, and C is given in Table 1.

TABLE 1

| Component | A | B | C |
|---|---|---|---|
| $Na_2CO_3$ | 2.0% | 2.0% | 2.0% |
| Na Citrate | 1.5% | 1.5% | 1.5% |
| Glucupon TM 625[1] | — | 5.0% | — |
| Glucupon TM 425[1] | — | — | 5.0% |
| Neodol TM 25-7[2] | 2.5% | — | — |
| Water | 94.0% | 91.5% | 91.5% |

[1]50% active.
[2]100% active Neodol TM 25-7 is a $C_{12-15}$ linear primary alcohol with 7 moles of EO.

TABLE 2

| | Microbiological Recovery | | | | | |
|---|---|---|---|---|---|---|
| | Sample A | | Sample B | | Sample C | |
| Barquat[1] | Ec[2] | Sa[3] | Ec | Sa | Ec | Sa |
| Sterile $H_2O$ | 2 | 2 | 2 | 3 | 3 | 2 |
| 0 | 4 | 2 | 2 | 3 | 3 | 3 |
| 15.6 | 4 | 2 | 2 | 2 | 2 | 2 |
| 31.25 | 4 | 2 | 3 | 2 | 2 | 2 |
| 62.5 | 1 | 1 | 2 | 2 | 2 | 1 |
| 125 | 2 | 1 | 0 | 1 | 0 | 1 |
| 250 | 0 | 1 | 0 | 1 | 0 | 0 |
| 500 | 0 | 0 | 0 | 0 | 0 | 0 |
| 1000 | 0 | 0 | 0 | 0 | 0 | 0 |
| 2000 | 0 | 0 | 0 | 0 | 0 | 0 |

[1]Barquat ® 4250Z in ppm.
[2]Ec is *E. coli*
[3]Sa is *S. aureus*

What is claimed is:

1. A process for increasing the germicidal efficiency of a disinfectant cleaning formulation which comprises adding to said disinfectant cleaning formulation an effective amount of a compound of the formula I $$R—O(—G)_n \qquad I$$

wherein R is an alkyl group having from 8 to 16 carbon atoms, G is a glucose residue; and n is 1.6; wherein said formulation is comprised of a mixture of $C_{12-18}$ alkyl dimethylbenzylammonium chlorides, and wherein the weight ratio of said mixture to said compound of formula I is from about 10:1 to about 1:10.

2. The process of claim 1 wherein in said compound of formula I R is a $C_{12-16}$ alkyl group.

* * * * *